US011598151B2

(12) United States Patent
Wang et al.

(10) Patent No.: US 11,598,151 B2
(45) Date of Patent: Mar. 7, 2023

(54) DOWNHOLE POWER DRILLING TOOL HAVING MULTI-STAGE DUAL PLUNGER ECCENTRIC GEAR MECHANISM

(71) Applicant: CHINA UNIVERSITY OF GEOSCIENCES (BEIJING), Beijing (CN)

(72) Inventors: Yu Wang, Beijing (CN); Jiaxing Lu, Beijing (CN); Zhiqiao Wang, Beijing (CN); Baolin Liu, Beijing (CN); Qin Zhou, Beijing (CN); Tengteng Chang, Beijing (CN)

(73) Assignee: CHINA UNIVERSITY OF GEOSCIENCES (BEIJING), Beijing (CN)

( * ) Notice: Subject to any disclaimer, the term of this patent is extended or adjusted under 35 U.S.C. 154(b) by 71 days.

(21) Appl. No.: 17/331,646

(22) Filed: May 27, 2021

(65) Prior Publication Data

US 2021/0285289 A1 Sep. 16, 2021

Related U.S. Application Data

(63) Continuation of application No. PCT/CN2019/126387, filed on Dec. 18, 2019.

(30) Foreign Application Priority Data

Oct. 22, 2019 (CN) ..... 201911007463.X

(51) Int. Cl.
*E21B 4/02* (2006.01)
*E21B 4/00* (2006.01)

(52) U.S. Cl.
CPC ..... *E21B 4/006* (2013.01); *E21B 4/02* (2013.01)

(58) Field of Classification Search
CPC .. E21B 4/006; E21B 4/02; F03C 1/002; F03C 1/08; F03C 1/2446; F03C 1/26
See application file for complete search history.

(56) References Cited

U.S. PATENT DOCUMENTS 3,083,779 A * 4/1963 Rowley ..... E21B 4/006 175/93
3,972,659 A 8/1976 Bosch et al.
4,880,065 A * 11/1989 McDonald ..... E21B 4/02 173/63
6,527,513 B1 * 3/2003 Van Drentham-Susman ..... E21B 4/02 415/903
8,616,303 B2 * 12/2013 Rupp ..... E21B 7/00 475/11
2004/0028536 A1 * 2/2004 Bakke ..... E21B 4/02 417/273

(Continued)

FOREIGN PATENT DOCUMENTS

CN 1279366 1/2001
CN 1401894 3/2003

(Continued)

*Primary Examiner* — Robert E Fuller
(74) *Attorney, Agent, or Firm* — Cooper Legal Group, LLC

(57) ABSTRACT

A downhole power drilling tool includes a flow distribution shaft, an outer pipe and a multi-stage eccentric gear driving mechanism which are coaxially arranged, the flow distribution shaft is suspended and supported in the outer pipe by the multi-stage eccentric gear driving mechanism.

9 Claims, 5 Drawing Sheets

(56) References Cited

U.S. PATENT DOCUMENTS

| | | | | |
|---|---|---|---|---|
| 2008/0135292 | A1* | 6/2008 | Sihler | E21B 44/005 175/27 |
| 2017/0051732 | A1 | 2/2017 | Hernandez et al. | |
| 2021/0123325 | A1* | 4/2021 | Church | E21B 4/18 |

FOREIGN PATENT DOCUMENTS

| | | |
|---|---|---|
| CN | 203835612 | 9/2014 |
| CN | 107060637 | 8/2017 |
| CN | 109441708 | 3/2019 |
| CN | 210829061 | 6/2020 |

* cited by examiner

DOWNHOLE POWER DRILLING TOOL HAVING MULTI-STAGE DUAL PLUNGER ECCENTRIC GEAR MECHANISM

CROSS-REFERENCE TO RELATED APPLICATION

The present application is a continuation of international application of PCT application No. PCT/CN2019/126387 filed on Dec. 18, 2019, which claims the priority benefit of China application No. 201911007463.X filed on Oct. 22, 2019. The entirety of the above-mentioned patent application is incorporated herein by reference and made a part of this specification.

BACKGROUND

Technical Field

This application relates to a power drilling tool, and more particularly, to an all-metal downhole power drilling tool driven by high-temperature drilling fluid and based on a multi-stage dual plunger eccentric gear mechanism.

Description of Related Art

In the field of high-temperature deep drilling such as earth deep drilling, high-temperature terrestrial heat, ultra-deep wells, it is an inevitable choice to use a downhole power drilling tool to drive drilling and coring. The downhole power drilling tool mainly includes two basic types, namely a screw drill and a turbine drill. The all-metal turbine drill has the advantages of high temperature resistance, corrosion resistance and the like, is the only power drilling tool capable of drilling under a high-temperature and high-pressure environment with the temperature exceeding 250° C. at present, but is high in rotating speed and low in torque. As a positive displacement motor drill, the screw drill has a good mechanical output characteristic, but the high-temperature screw motor can quickly fail when its rubber stator exceeds 180° C., and cannot adapt to long-time drilling operation under the high temperature working condition at the bottom of a well. The metal screw adopts the stator with an all-metal structure, and the curved surface structure of the stator is high in processing difficulty, easy to wear and high in cost. These power drilling tools suffer from defects in the aspects of temperature resistance, machining characteristics, output characteristics and the like, which seriously affects the mechanical efficiency and service life of the power drilling tool.

SUMMARY

In view of the above-mentioned drawbacks and shortcomings in the prior art, it is an object of the present application to provide an all-metal downhole power drilling tool which is suitable for a high-temperature environment, simple to process, good in sealing effect and capable of increasing the torque.

The object of the present application is achieved by the following solutions:

An all-metal downhole power drilling tool based on a multi-stage dual plunger eccentric gear mechanism includes a flow distribution shaft, an outer pipe and a multi-stage eccentric gear driving mechanism which are coaxially arranged, wherein the flow distribution shaft is suspended and supported in the outer pipe by the multi-stage eccentric gear driving mechanism;

the eccentric gear driving mechanism includes a planetary gear train coaxially arranged, and plunger driving structures symmetrically arranged on two axial end faces of the planetary gear train; two pairs of planetary gears which are symmetrically distributed are arranged on a planetary carrier of the planetary gear train, a gear ring of the planetary gear train is in interference fit with the outer pipe; each plunger driving structure includes a mounting block, a through hole is formed in the center of the mounting block, and the inner diameter of the through hole is the same as the inner diameter of a sun gear of the planetary gear train; four plunger passages are formed in the radial direction of the mounting block, and four plunger passages are annularly and uniformly distributed; each plunger passage is filled with a plunger in a sliding fit; a guide post is integrally formed in the wall of the plunger, the axial direction of the guide post is the same as the axial direction of the flow distribution shaft, and a guide groove is formed at a position corresponding to the guide post of the plunger passage; the guide groove facing one side of the planetary gear train is a through groove, and the guide post extends through the through groove to be in one-to-one corresponding eccentric connection with the planetary gear on the planetary gear train;

one end of the flow distribution shaft is open, the other end of the flow distribution shaft is closed, and an inner cavity of the flow distribution shaft is a flow distribution passage; the multi-stage eccentric gear driving mechanisms are arranged on the flow distribution shaft at intervals in the axial direction, a sun gear is keyed onto the flow distribution shaft; four rows of water inlet ports and four rows of water outlet grooves are uniformly and circumferentially formed in the flow distribution shaft, the water inlet ports are communicated with the flow distribution passage, the water inlet ports and the water outlet grooves in each row are spaced apart from each other, and an angular difference between the water inlet ports and the water outlet grooves in adjacent rows is 45°; an angular difference between the eccentric gear driving mechanisms in two adjacent stages is 45°, and when the plunger passage of one stage of the eccentric gear driving mechanism is right opposite to and communicated with the water inlet port on the flow distribution shaft, the plunger passage of an adjacent eccentric gear driving mechanism is right opposite to and communicated with the water outlet groove.

Preferably, the water inlet port is an oblong hole or an elliptical hole, an opening of the plunger passage is a circular hole, and a projection of the oblong hole or the elliptical hole is inscribed in the circular hole.

Preferably, the water inlet port is a circular hole, an opening of the plunger passage is an oblong hole or an elliptical hole, and a projection of the oblong hole or the elliptical hole is inscribed in the circular hole.

Preferably, one end of the outer pipe corresponding to the opening of the distribution shaft is connected with a connector, and the other end of the outer pipe is connected with a retainer ring; the all-metal downhole power drilling tool based on a multi-stage dual plunger eccentric gear mechanism further includes a spindle, the spindle is inserted into the retainer ring and is connected to a closed end of the flow distribution shaft, and the spindle is supported in the retainer ring via a bearing.

Preferably, the water outlet groove communicates with the spindle passage.

Preferably, the other end of the retainer ring is arranged with an end face seal.

Preferably, one end of the flow distribution shaft connected to the spindle extends outwards to form a regular polygonal plug, and one end of the spindle passage facing the flow distribution shaft is formed with a corresponding regular polygonal plug receptacle.

Preferably, the water outlet groove extends to a side wall of the regular polygonal plug and forms a water passing gap at a mating surface of the regular polygonal plug and the regular polygonal plug receptacle.

Preferably, supporting structures are respectively arranged between two stages of eccentric gear driving mechanisms, and on two sides of the two stages of eccentric mechanisms relatively far away from each other, the supporting structures are fixedly connected to the flow distribution shaft, and are rotatably fitted to the outer pipe.

Preferably, openings of the annular gaps between the flow distribution shaft and the eccentric gear driving mechanisms are sealed by means of mechanical sealing on both sides of the two stages of eccentric gear driving mechanisms.

Compared with the prior art, embodiments of the present application at least have the following advantages:

With reference to the plunger type motor, the plunger structure is easy to process, and good in plunger type movable sealing effect. A planetary gear train is adopted to transmit torque, improving the working efficiency of the drilling tool. The all-metal downhole power drilling tool based on a multi-stage dual plunger eccentric gear mechanism not only effectively alleviates the poor sealing effect of the drilling tool, but is also capable of mounting multiple stages of plunger structures for relay type driving. The dual plunger structure is adopted to guarantee balance and stability of the internal force, and the torque of the drilling tool can be increased.

In particular:

1. The multi-stage eccentric gear driving mechanism is adopted for rotary relay, the flow distribution shaft is connected to the multi-stage eccentric gear driving mechanism, so that the plungers between adjacent stages are staggered by 45°, the cycle relay overcomes the rotary failure points, meanwhile, the plunger is good in the movable sealing effect, low in processing requirements and large in torque.

2. The suspended central distribution shaft is adopted for flow distribution, the water inlet port is an oblong hole or an elliptical hole, an opening of the plunger passage is a circular hole, and vice versa, therefore, the flow rate of the inlet of the plunger passage is increased. Meanwhile, the water outlet groove and the water inlet port are staggered by 45°. An elliptical water outlet groove is axially formed in the axial surface of the flow distribution shaft, and the water outlet grooves corresponding to the two-stage eccentric gear driving mechanisms are correspondingly arranged. A water outlet groove away from the spindle is open toward one end of the spindle, and the other end is closed. Both ends of the water outlet groove close to the spindle are open, so that the water inlet and the water outlet of flow distribution are on the same shaft, which greatly simplifies the flow distribution structure and optimizes the flow distribution form.

DESCRIPTION OF THE EMBODIMENTS

The present application is further illustrated in detail in combination with embodiments and the accompanying drawings hereinafter. These embodiments are merely explanatory and are not restrictive of the application.

Figure 1:
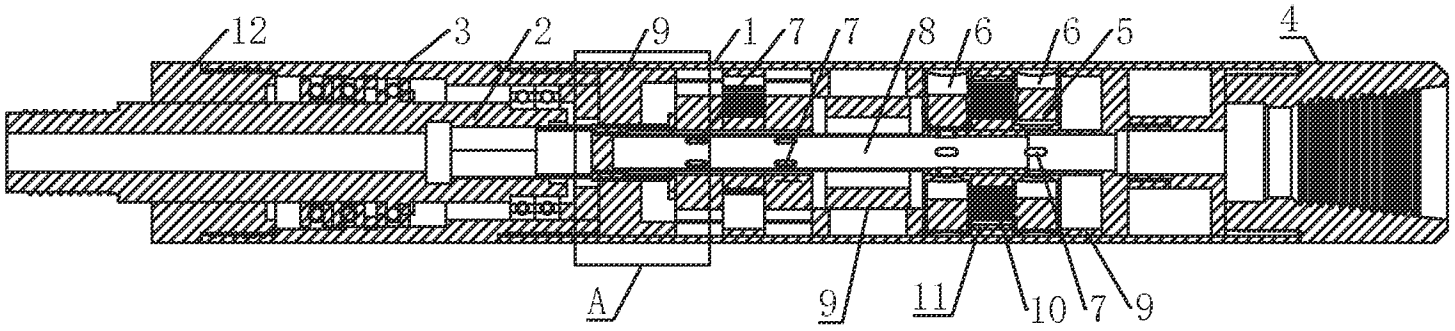
FIG. 1 is a schematic sectional diagram of a power drilling tool according to an embodiment.
Figure 7:
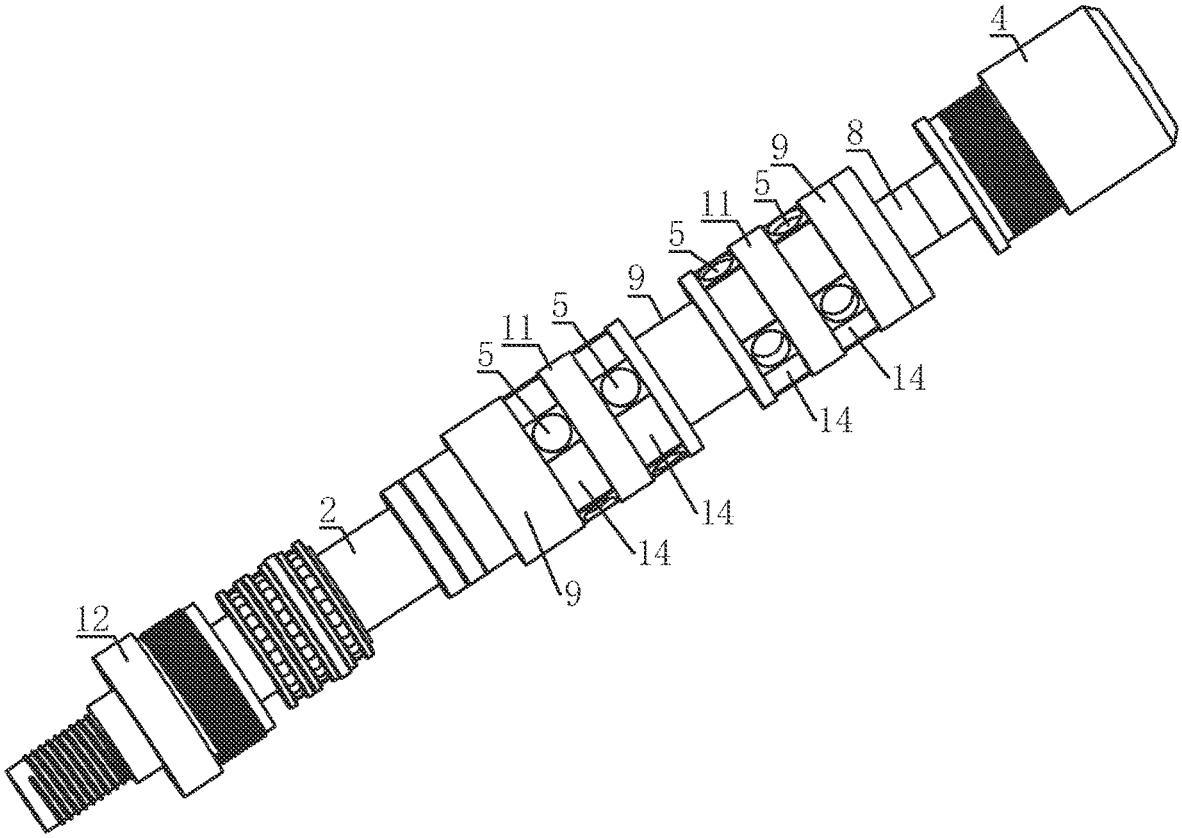
FIG. 7 is a schematic structural diagram of a power drilling tool according to an embodiment without an outer tube and a retainer ring.

As shown in FIGS. 1 and 7, an all-metal downhole power drilling tool based on a multi-stage dual plunger eccentric gear mechanism includes a flow distribution shaft 8, an outer pipe 1 and a multi-stage eccentric gear driving mechanism 19 which are coaxially arranged. The flow distribution shaft 8 is suspended and supported in the outer pipe 1 by the multi-stage eccentric gear driving mechanism 19.

Figure 3:
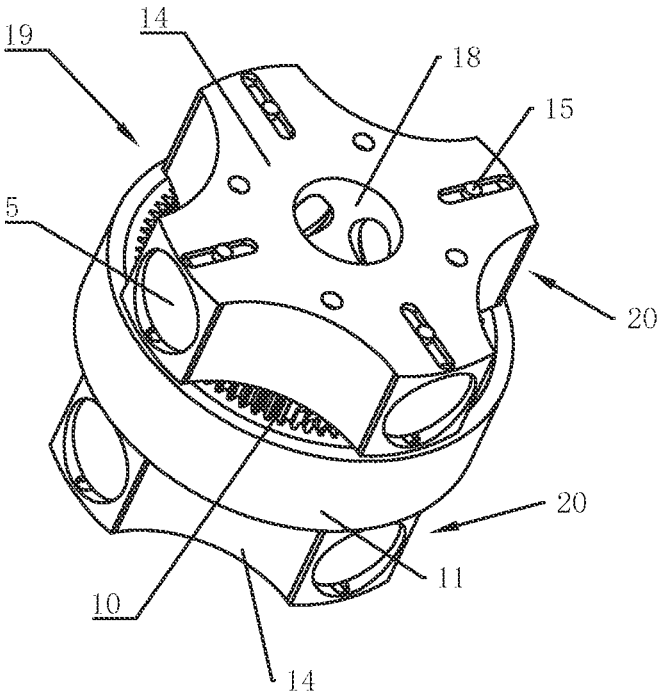
FIG. 3 is a schematic structural diagram of an eccentric gear driving mechanism according to an embodiment.
Figure 4:
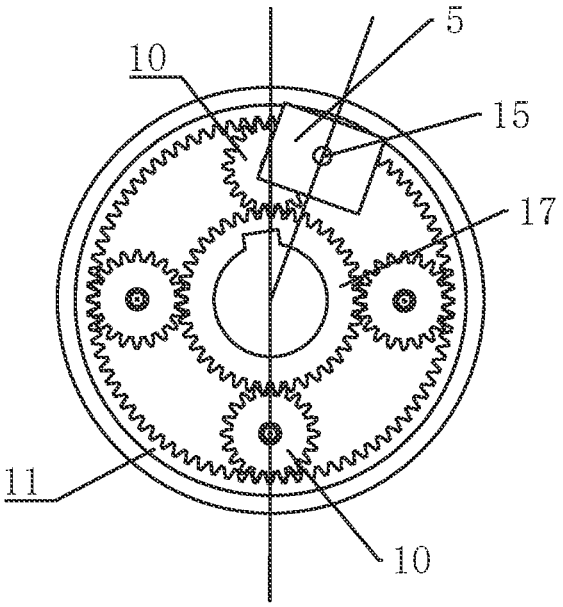
FIG. 4 is a schematic diagram showing the eccentric connection relationship between the plunger and the planetary gear according to an embodiment.

As shown in FIGS. 3 and 4, the eccentric gear driving mechanism 19 includes a planetary gear train coaxially arranged, and plunger driving structures 20 symmetrically arranged on two axial end faces of the planetary gear train. Four planetary gears 10 are arranged on a planetary carrier of the planetary gear train, and a gear ring 11 of the planetary gear train is in interference fit with the outer pipe 1. The plunger driving structure 20 includes a mounting block 14, a through hole 18 is formed in the center of the mounting block 14, and the inner diameter of the through hole 18 is the same as the inner diameter of a sun gear 17 of the planetary gear train. Four plunger passages 6 are formed in the radial direction of the mounting block 14, and four plunger passages 6 (cylinders) are annularly and uniformly distributed. Each plunger passage 6 is filled with a plunger 5 (piston) in a sliding fit. A guide post 15 is integrally formed in the wall of the plunger 5, the axial direction of the guide post 15 is the same as the axial direction of the flow distribution shaft 8, and a guide groove is formed at a position corresponding to the guide post 15 of the plunger passage 6. The guide groove facing one side of the planetary gear train is a through groove, and the guide post 15 extends through the through groove to be in one-to-one corresponding eccentric connection with the planetary gear 10 on the planetary gear train. Specifically, a clearance is formed between the two side edges of the through groove and the guide post 15, so that the planetary gear 10 does not interfere with the linear stroke of the plunger 5 during rotation. The plunger 5 is driven by the planetary gear 10 to perform small amplitude rotation with its axis as the axis of rotation while the plunger 5 makes a linear motion.

Figure 2:
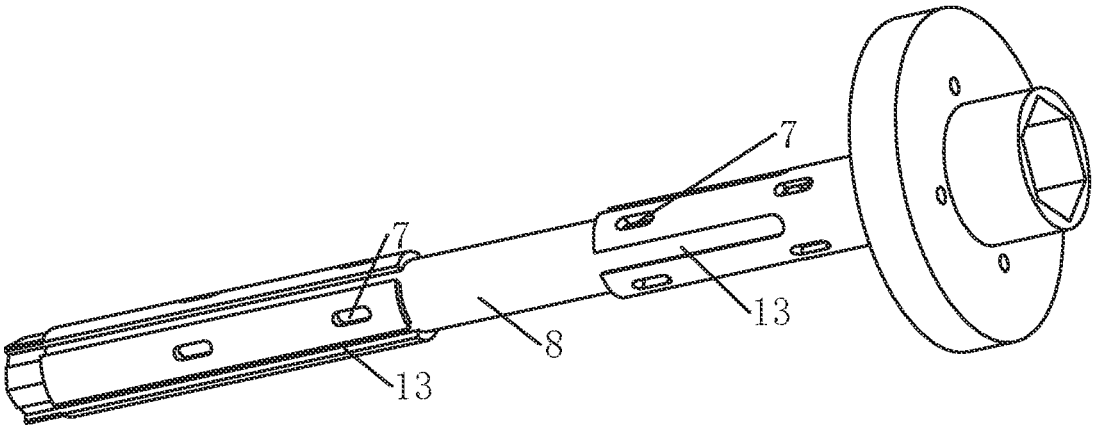
FIG. 2 is a schematic structural diagram of a flow distribution shaft according to an embodiment.

As shown in FIG. 2, one end of the flow distribution shaft 8 is open, the other end of the flow distribution shaft 8 is closed, and an inner cavity of the flow distribution shaft 8 is a flow distribution passage. The multi-stage eccentric gear driving mechanisms 19 are arranged on the flow distribution shaft 8 at intervals in the axial direction, a sun gear 17 is keyed onto the flow distribution shaft 8. Four rows of water inlet ports 7 and four rows of water outlet grooves 13 are uniformly and circumferentially formed in the flow distribution shaft 8, the water inlet ports 7 are communicated with the flow distribution passage, the water inlet ports 7 and the water outlet grooves 13 in each row are spaced apart from each other, and an angular difference between the water inlet ports 7 and the water outlet grooves 13 in adjacent rows is 45°. An angular difference between the eccentric gear driving mechanisms 19 in two adjacent stages is 45°, and when the plunger passage 6 of one stage of the eccentric gear driving mechanism 19 is right opposite to and communicated with the water inlet port 7 on the flow distribution shaft 8, the plunger passage 6 of an adjacent eccentric gear driving mechanism 19 is right opposite to and communicated with the water outlet groove 13.

The water inlet port 7 is an oblong hole or an elliptical hole, an opening of the plunger passage 6 is a circular hole, and a projection of the oblong hole or the elliptical hole is inscribed in the circular hole. On the contrary, the water inlet port 7 is a circular hole, an opening of the plunger passage 6 is an oblong hole or an elliptical hole, and a projection of the oblong hole or the elliptical hole is inscribed in the circular hole. The fitting structure is capable of increasing the water inlet flow rate of the plunger passage 6.

One end of the outer pipe 1 corresponding to the opening of the distribution shaft 8 is connected with a connector 4, and the other end of the outer pipe 1 is connected with a retainer ring 3. There is also provided a spindle 2, the spindle 2 is inserted into the retainer ring 3 and is connected to a closed end of the flow distribution shaft 8, and the spindle 2 is supported in the retainer ring 3 via a bearing. The other end of the retainer ring 3 is arranged with an end face seal.

Figure 5:
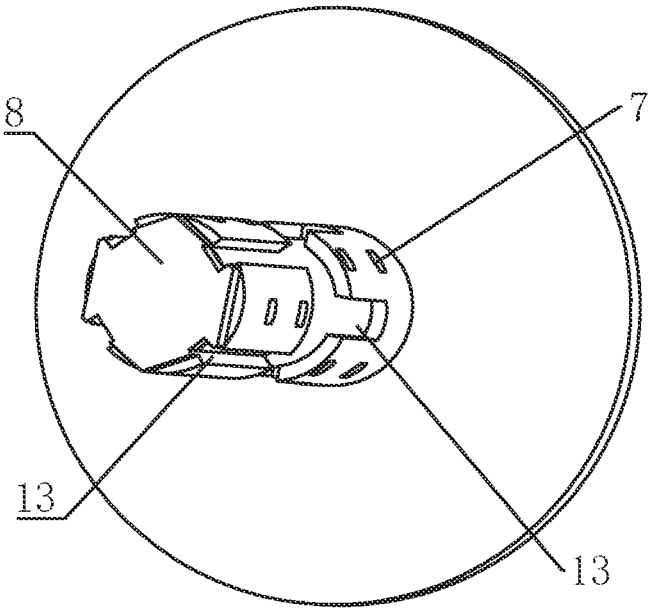
FIG. 5 is a schematic diagram of the closed end of a flow distribution shaft according to an embodiment.
Figure 6:
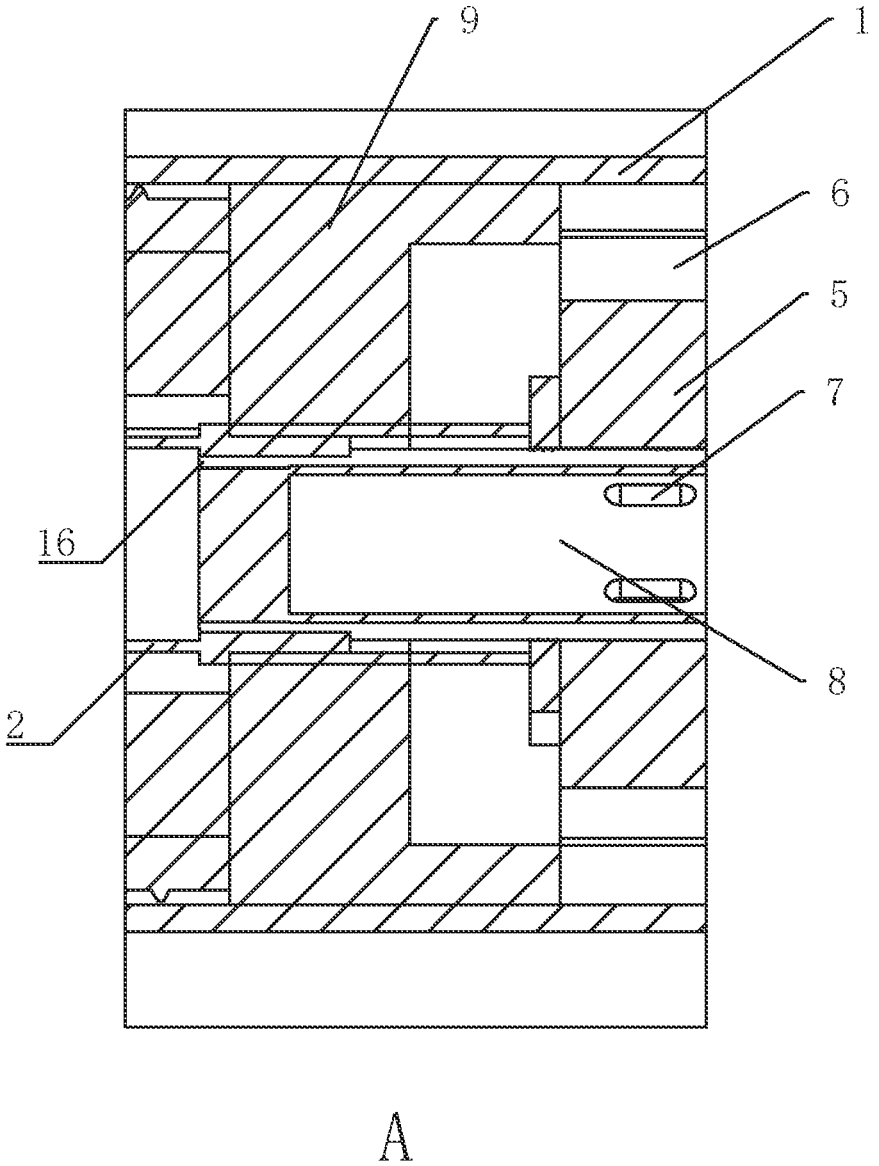
FIG. 6 is an enlarged view of a structure enclosed by a dotted line box A in FIG. 1.

As shown in FIGS. 5 and 6, the water outlet groove 13 communicates with the spindle 2 passage. One end of the flow distribution shaft 8 connected to the spindle 2 extends outwards to form a regular polygonal plug, one end of the spindle 2 passage facing the flow distribution shaft 8 is formed with a corresponding regular polygonal plug receptacle, and the water outlet groove 13 extends to a side wall of the regular polygonal plug and forms a water passing gap 16 at a mating surface of the regular polygonal plug and the regular polygonal plug receptacle.

Supporting structures 9 are respectively arranged between two stages of eccentric gear driving mechanisms 19, and on two sides of the two stages of eccentric mechanisms relatively far away from each other, the supporting structures 9 are fixedly connected to the flow distribution shaft 8, and are rotatably fitted to the outer pipe 1. Openings of the annular gaps between the flow distribution shaft 8 and the eccentric gear driving mechanisms 19 are sealed by mechanical sealing on both sides of the two stages of eccentric gear driving mechanisms 19.

The flow distribution process of the all-metal power drilling tool according to the present application is as follows:

High-pressure water enters through the flow distribution passage of the flow distribution shaft 8, and enters the plunger passage 6 through the water inlet 7 of the first-stage eccentric gear driving mechanism 19 to push the plunger 5 to work, the plunger 5 pushes the planetary gear 10 to rotate, and meanwhile, the planetary gear 10 rotates clockwise around a central sun gear 17 to drive the plunger driving structure 20 to rotate, and in turn drive the flow distribution shaft 8 and the spindle 2 connected to the flow distribution shaft 8 to rotate. At this time, the opening of the plunger passage 6 of the first-stage eccentric gear driving mechanism 19 rotates by a certain angle and finally rotates to the water outlet groove 13 from the water inlet 7 through a blind cylindrical surface between the water inlet 7 and the water outlet groove 13 (the gear ratio of the gear ring 11 to the sun gear 17 to the planetary gear 10 is 1:2:4, due to the angular relationship, when the plunger 5 moves to the maximum stroke; the planetary gear 10 rotates by half a turn, and also drives the sun gear 17 to rotate by one eighth turn; the water inlet ports 7 and the water outlet grooves 13 in each row on the flow distribution shaft 8 just divide the flow distribution shaft 8 into eight equal parts), and meanwhile, the plunger passage 6 of the second-stage eccentric gear driving mechanism 19 finally rotates to the water inlet 7 corresponding to the plunger passage 6 from the water outlet groove 13 through a blind cylindrical surface between the water outlet groove 13 and the water inlet 7, high-pressure water is communicated to push a plunger 5 in the plunger passage 6 to work; and the specific stroke is the same as the stroke of the first-stage eccentric gear driving mechanism 19. Meanwhile, the second-stage eccentric gear driving mechanism 19 drives the plunger 5 of the first-stage eccentric gear driving mechanism 19 to do return stroke movement, to discharge water in the plunger passage 6 when passing through the position corresponding to the water outlet groove 13 of the first-stage eccentric gear driving mechanism 19, ready for the next cycle stroke, and at this point, a rotation cycle is completed. In this way, a reciprocating working process similar to that of a plunger motor is achieved, increasing the sealing effect while guaranteeing the torque of the drilling tool.

The above description is only preferred embodiments of the present application and is not intended to limit the protection scope of the present application. After reading this specification, those skilled in the art can make various alterations and modifications to the embodiments as needed without creative work, which falls within the protection scope defined by the appended patent claims.

What is claimed is:

1. A downhole power drilling tool, comprising:

a flow distribution shaft, an outer pipe, and a plurality of eccentric gear driving mechanisms which are coaxially arranged, wherein the flow distribution shaft is suspended and supported in the outer pipe by the plurality of eccentric gear driving mechanisms;

each of the plurality of eccentric gear driving mechanisms defining a stage and comprising:

a planetary gear train, and plunger driving structures symmetrically arranged on two axial end faces of the planetary gear train;

wherein two pairs of planetary gears which are symmetrically distributed are arranged on a planetary carrier of the planetary gear train, a gear ring of the planetary gear train is in an interference fit with the outer pipe; each of the plunger driving structures comprises a mounting block, a through hole is formed in a center of the mounting block, and an inner diameter of the through hole is the same as an inner diameter of a sun gear of the planetary gear train; four plunger passages are formed in a radial direction of the mounting block, and the four plunger passages are uniformly distributed around the center of the mounting block; each of the four plunger passages is filled with a plunger in a sliding fit; a guide post is integrally formed in a wall of the plunger, an axial direction of the guide post is the same as an axial direction of the flow distribution shaft, and a guide groove is formed at a position corresponding to the guide post of a corresponding one of the four plunger passages; the guide groove facing one side of the planetary gear train is a through groove, and the guide post extends through the through groove to be in eccentric connection with one of the two pairs of planetary gears on the planetary gear train; and wherein one end of the flow distribution shaft is open, a second end of the flow distribution shaft is closed, and an inner cavity of the flow distribution shaft is a flow distribution passage; the plurality of eccentric gear driving mechanisms are arranged on the flow distribution shaft at intervals in the axial direction of the flow distribution shaft, the sun gear is keyed onto the flow distribution shaft; four rows of water inlet ports and four rows of water outlet grooves are uniformly and circumferentially formed in the flow distribution shaft, the water inlet ports are in fluid communication with the flow distribution passage, the water inlet ports and the water outlet grooves in each row are spaced apart from each other, and an angular difference between the water inlet ports and the water outlet grooves in adjacent rows is 45°; an angular difference between eccentric gear driving mechanisms of the plurality of eccentric gear driving mechanisms in two adjacent stages is 45°, and when the four plunger passages of one stage are in fluid communication with the water inlet ports on the flow distribution shaft, the four plunger passages of an adjacent stage are in fluid communication with the water outlet grooves.

2. The downhole power drilling tool according to claim 1, wherein each of the water inlet ports is an oblong hole or an elliptical hole, and each of the four plunger passages has an opening which is a circular hole, and a projection of the oblong hole or the elliptical hole is inscribed in the circular hole.

3. The downhole power drilling tool according to claim 2, wherein one end of the outer pipe corresponding to an opening of the flow distribution shaft is connected with a connector, and a second end of the outer pipe is connected with a retainer ring; the downhole power drilling tool further comprises a spindle, wherein the spindle is disposed in the retainer ring and is connected to the second end of the flow distribution shaft, and the spindle is supported in the retainer ring via a bearing.

4. The downhole power drilling tool according to claim 3, wherein the water outlet grooves communicate with a spindle passage.

5. The downhole power drilling tool according to claim 4, wherein the one end of the flow distribution shaft connected to the spindle extends outwards to form a regular polygonal plug, and one end of the spindle passage facing the flow distribution shaft is formed with a corresponding regular polygonal plug receptacle.

6. The downhole power drilling tool of claim 5, wherein each of the water outlet grooves extends to a side wall of the regular polygonal plug and forms a water passing gap at a mating surface of the regular polygonal plug and the corresponding regular polygonal plug receptacle.

7. The downhole power drilling tool according to claim 3, wherein an end of the retainer ring is arranged with an end face seal.

8. The downhole power drilling tool according to claim 1, wherein each of the water inlet ports is a circular hole, and each of the four plunger passages has an opening which is an oblong hole or an elliptical hole, and a projection of the oblong hole or the elliptical hole is inscribed in the circular hole.

9. The downhole power drilling tool according to claim 1, wherein supporting structures are respectively arranged between two adjacent stages, and the supporting structures are fixedly connected to the flow distribution shaft, and are rotatably fitted to the outer pipe.

* * * * *